US008007315B2

(12) United States Patent
Whiteman, Jr.

(10) Patent No.: US 8,007,315 B2
(45) Date of Patent: Aug. 30, 2011

(54) ELECTRICAL CONNECTOR SYSTEM HAVING REDUCED MATING FORCES

(75) Inventor: Robert Neil Whiteman, Jr., Middletown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/493,842

(22) Filed: Jun. 29, 2009

(65) Prior Publication Data

US 2010/0330820 A1 Dec. 30, 2010

(51) Int. Cl.
*H01R 13/648* (2006.01)

(52) U.S. Cl. ..... 439/607.05; 439/924.1

(58) Field of Classification Search ..... 439/607.05–607.09, 607.11, 701, 108, 79, 65, 924.1
See application file for complete search history.

(56) References Cited

U.S. PATENT DOCUMENTS 3,711,819 A * 1/1973 Matthews ..... 439/682
6,033,258 A * 3/2000 Huang et al. ..... 439/541.5
6,371,773 B1 * 4/2002 Crofoot et al. ..... 439/79
6,390,857 B1 * 5/2002 Pickles et al. ..... 439/680
6,712,646 B2 * 3/2004 Shindo ..... 439/607.07
7,318,757 B1 1/2008 Minich ..... 439/701
7,320,609 B1 * 1/2008 Minich ..... 439/79
2003/0027442 A1 2/2003 Ortega et al.
2006/0148316 A1 7/2006 Dillon et al.
2008/0003890 A1 1/2008 Minich

OTHER PUBLICATIONS

European Search Report. European Application No. 10167573.4-2214, European Filing Date Jun. 28, 2010.

* cited by examiner

*Primary Examiner* — Javaid Nasri

(57) ABSTRACT

An electrical connector system includes a circuit board having a mounting side and first and second electrical connectors mounted to the mounting side of the circuit board. The first and second electrical connectors each having a mating interface. The first and second electrical connectors being mounted to the circuit board in an offset configuration such that the mating interfaces of the first and second electrical connectors are parallel to one another and non-coplanar with respect to one another. Optionally, the mating interfaces may be perpendicular to the mounting side. The first and second electrical connectors may be identical to one another.

20 Claims, 5 Drawing Sheets

ELECTRICAL CONNECTOR SYSTEM HAVING REDUCED MATING FORCES

BACKGROUND OF THE INVENTION

The subject matter herein relates generally to electrical connector systems, and more particularly, to methods and systems for reducing mating forces between electrical connectors.

Some electrical connector systems utilize electrical connectors to interconnect two circuit boards to one another. In some applications, the circuit boards may be oriented perpendicular to one another with the circuit boards arranged in either a backplane arrangement or in a midplane arrangement with one of the circuit boards being a midplane circuit board. In either arrangement, typically multiple connector halves are mated together simultaneously.

There is a trend to increase the density of electrical connectors to accommodate higher data transmission speeds. The increase in contacts associated with the increased density leads to increased mating forces when mating each of the connectors together. Having multiple connectors mating simultaneously compounds the mating forces required to mate the connector assemblies together. To address the high mating forces, some known systems have been developed that have contacts of different lengths to create a sequenced mating interface. However, such systems are not without disadvantages. For example, it is costly to design, tool and manufacture connectors that, have different lengths of contacts. Additionally, the mating interface of the connectors is more complicated and requires a corresponding mating half, making such connectors less robust.

BRIEF DESCRIPTION OF THE INVENTION

In one embodiment, an electrical connector system is provided including a circuit board having a mounting side and first and second electrical connectors mounted to the mounting side of the circuit board. The first and second electrical connectors each having a mating interface. The first and second electrical connectors being mounted to the circuit board in an offset configuration such that the mating interfaces of the first and second electrical connectors are parallel to one another and non-coplanar with respect to one another. Optionally, the mating interfaces may be perpendicular to the mounting side. The first and second electrical connectors may be identical to one another.

In another embodiment, an electrical connector system is provided including a circuit board having a mounting side. A first electrical connector is mounted to the mounting side of the circuit board. The first electrical connector includes a housing having a mating end and a mounting end perpendicular to the mating end and a plurality of contact modules loaded into the housing. The contact modules of the first electrical connector include contacts positioned proximate to the mating end of the housing. A second electrical connector is mounted to the mounting side of the circuit board. The second electrical connector includes a housing having a mating end and a mounting end perpendicular to the mating end and a plurality of contact modules loaded into the housing. The contact modules of the second electrical connector include contacts positioned proximate to the mating end of the housing. The first and second electrical connectors are mounted to the circuit board in an offset configuration such that some of the contacts of the first electrical connector are configured for mating engagement prior to the contacts of the second electrical connector.

DETAILED DESCRIPTION OF THE INVENTION

Figure 1:
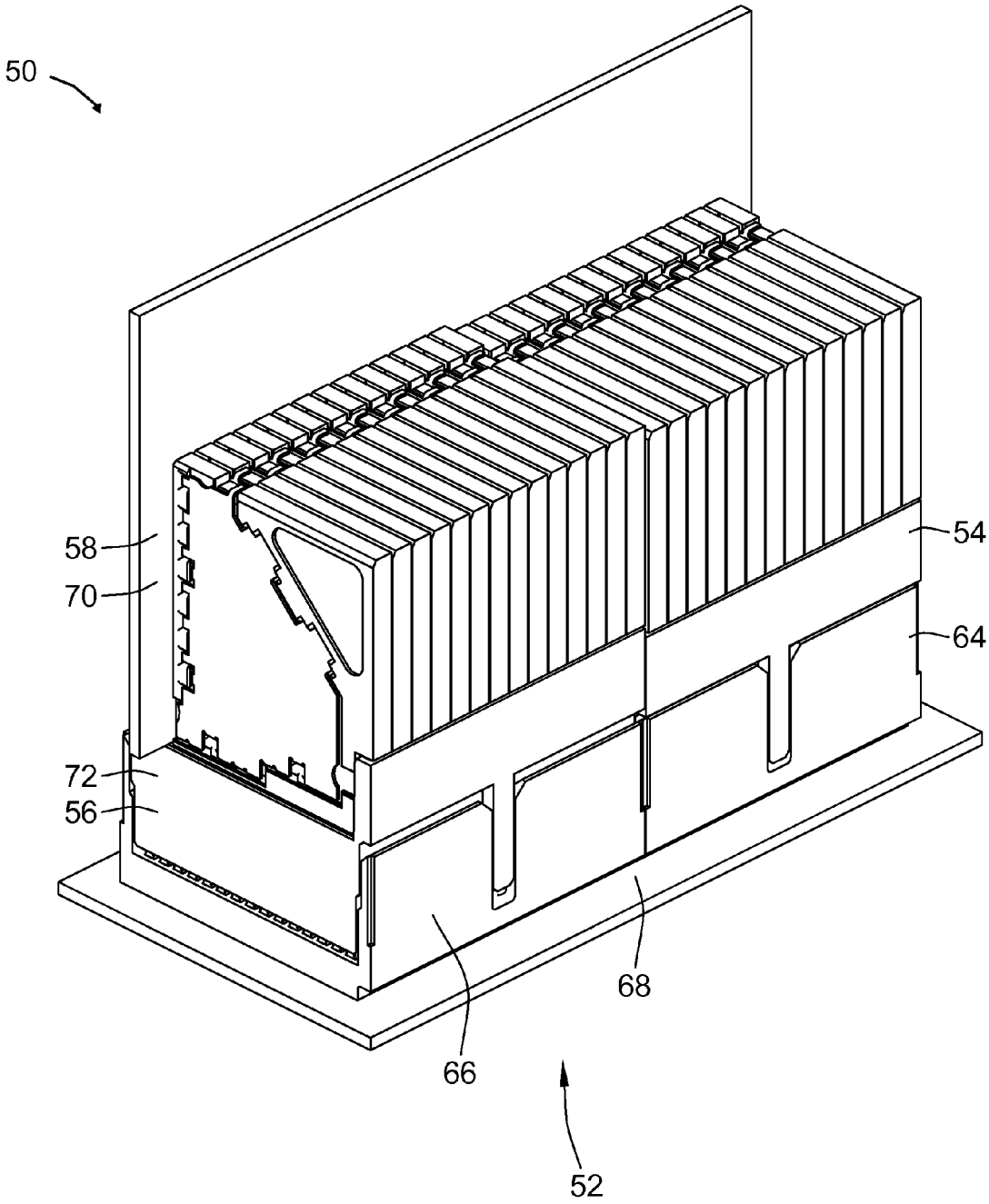
FIG. 1 illustrates an electrical connector system formed in accordance with an exemplary embodiment that is mated with a mating connector assembly.

FIG. 1 illustrates an electrical connector system 50 formed in accordance with an exemplary embodiment that is mated with a mating connector assembly 52. The electrical connector system 50 includes multiple electrical connectors 54, 56 mounted to a first circuit board 58. In an exemplary embodiment, the electrical connectors 54, 56 represent right angle electrical connectors, however other types of electrical connectors may be used in alternative embodiments. The electrical connectors 54, 56 constitute receptacle connectors, however the electrical connectors 54, 56 may be of another type, such as header connectors. Optionally, the electrical connectors 54, 56 may be cable mounted rather than board mounted and held by a common housing, frame or substrate in position for mating with the mating connector assembly 52.

While two electrical connectors 54, 56 are illustrated, it is realized that any number of electrical connectors 54, 56 may be provided in alternative embodiments. The electrical connectors 54, 56 are merely illustrative of features embodying the subject matter of the electrical connector system 50. The electrical connectors 54, 56 may be referred to hereinafter as first and second electrical connectors 54, 56, respectively. In an exemplary embodiment, the first and second electrical connectors 54, 56 are substantially identical to one another.

The mating connector assembly 52 includes multiple mating connectors 64, 66 mounted to a second circuit board 68. In an exemplary embodiment, the mating connectors 64, 66 represent header connectors that receive the electrical connectors 54, 56, however it is realized that the mating connectors 64, 66 may be of a different type in alternative embodiments. For example, the mating connectors 64, 66 may be receptacle connectors. In an alternative embodiment, the mating connectors 64, 66 may be right angle connectors having either a header interface or a receptacle interface. The mating connectors 64, 66 may be cable mounted rather than board mounted. While two mating connectors 64, 66 are illustrated, it is realized that any number of mating connectors 64, 66 may be provided in alternative embodiments. The mating connectors 64, 66 may be referred to hereinafter as first and second mating connectors 64, 66, respectively. In an exemplary embodiment, the first and second mating connectors 64, 66 are substantially identical to one another.

The electrical connectors 54, 56 are held together and mated with the mating connectors 64, 66 as a unit. Similarly, the mating connectors 64, 66 are held together and mated with the electrical connectors 54, 56 as a unit. Any number of electrical connectors and mating connectors may be assembled together and mated as a unit. The electrical connectors 54, 56 are held together by the first circuit board 58. The electrical connectors 54, 56 are both mounted to a mounting side 70 of the first circuit board 58 at a mating edge 72 of the first circuit board 58. Optionally, the electrical connectors 54, 56 may extend beyond and hang over the mating edge 72. A portion of the electrical connectors 54 and/or 56 extends over and faces the mating edge 72. The electrical connectors 54, 56 are located relative to the first circuit board 58 such that the mating edge 72 does not interfere with the mounting of the electrical connectors 54, 56. The relative position of the first electrical connector 54 is fixed with respect to the second electrical connector 56 by the first circuit board 58. For example, when the first and second electrical connectors 54, 56 are mounted to the circuit board 58, the positions are fixed. Similarly, the mating connectors 64, 66 are held together by the second circuit board 68. The relative position of the first mating connector 64 is fixed with respect to the second mating connector 66 by the second circuit board 68.

The electrical connector system 50 is mated with the mating connector assembly 52 such that the first circuit board 58 is oriented perpendicular with respect to the second circuit board 68. As explained in further detail below, the electrical connector system 50 is configured such that the first and second electrical connectors 54, 56 define a sequenced mating profile. The first and second electrical connectors 54, 56 are offset from one another such that the first electrical connector 54 mates with the first mating connector 64 prior to the second electrical connector 56 mating with the second mating connector 66. For example, a front face or mating interface of the first electrical connector 54 initially mates with the first mating connector 64 prior to the mating interface of the second electrical connector 56 initially mating with the second mating connector 66. The mating interfaces of the first and second electrical connectors 54, 56 are generally planar and parallel to one another, however the mating interfaces of the first and second electrical connectors 54, 56 are non-coplanar with respect to one another. The forward-most positions of the first and second electrical connectors 54, 56 are staggered with respect to one another to define an offset. Such staggering reduces the overall mating force of the electrical connector system 50 with the mating connector assembly 52.

Figure 2:
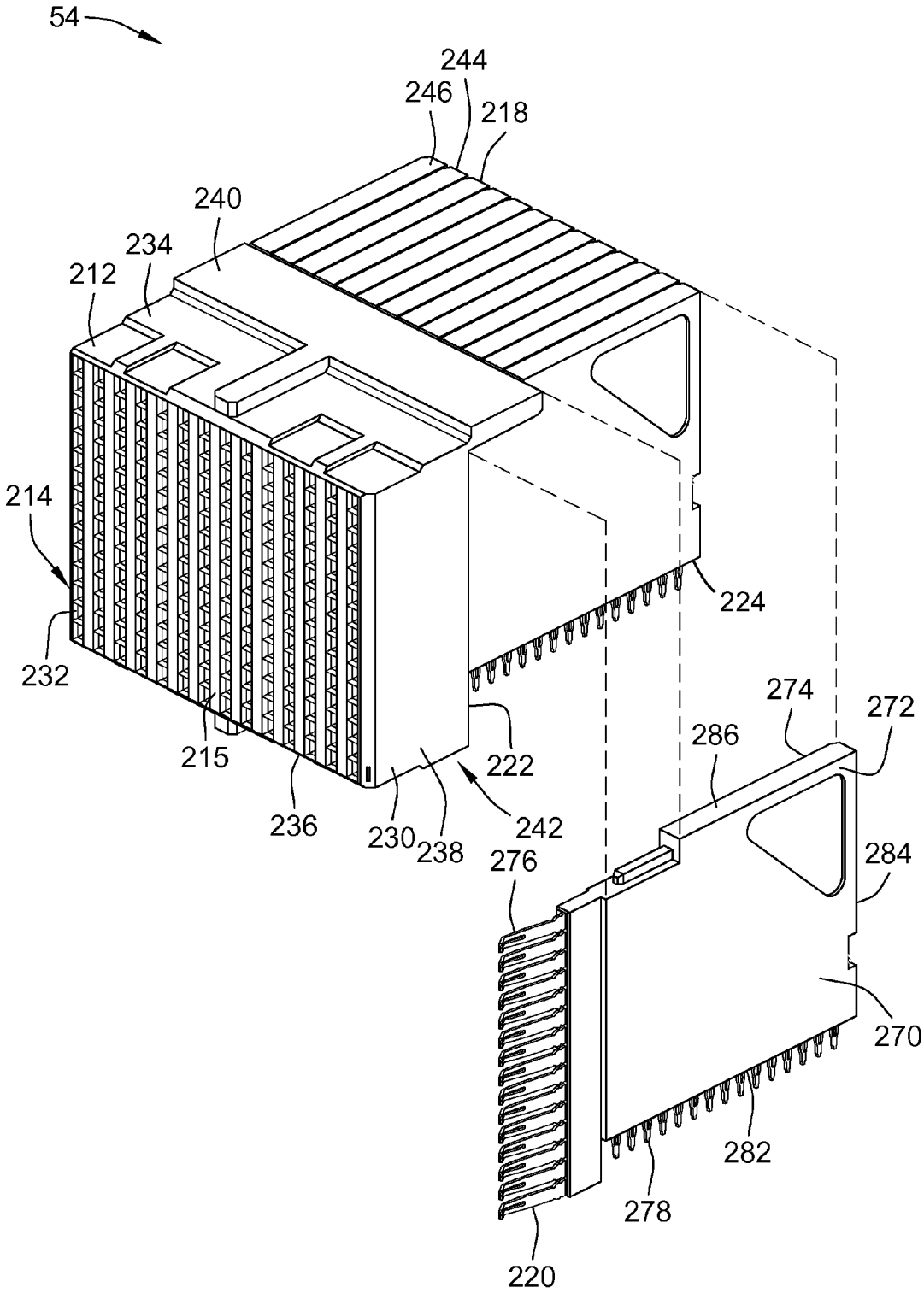
FIG. 2 is a front perspective view of a receptacle connector of the electrical connector system shown in FIG. 1.

FIG. 2 is a front perspective view of the first electrical connector 54 of the electrical connector system 50 (shown in FIG. 1). The second electrical connector 56 (shown in FIG. 1) may be substantially similar to the first electrical connector 54. Like components and features of the second electrical connector 56 may be identified with the same reference numerals.

The first electrical connector 54 includes a housing 212 having a mating face 214 at a front 216 of the housing 212. The mating face 214 is planar and defines the front or forward-most portion of the first electrical connector 54. The mating face 214 defines the mating interface of the first electrical connector 54. A plurality of contact modules 218 are held by the housing 212, one of which is shown unmated from the housing 212. The contact modules 218 include contacts 220 and both the contact modules 218 and the contacts 220 are loaded through a rear 222 of the housing 212. The contact modules 218 define a mounting face 224 of the first electrical connector 54. The mounting face 224 is configured to be mounted to the mounting side 70 of the first circuit board 58 (shown in FIG. 1). The mating face 214 is oriented perpendicular with respect to the mounting face 224, however non-perpendicular configurations are possible in alternative embodiments.

The housing 212 includes a body 230 extending between the front 216 and the rear 222. The contact modules 218 are coupled to the rear 222 of the housing 212. Optionally, at least a portion of the contact modules 218 may be loaded into the rear 222 and secured thereto.

A plurality of contact channels 232 extend through the body 230. The contact channels 232 receive portions of the contacts 220. The contact channels 232 are arranged in a pattern that complements the pattern of contacts 220.

The body 230 includes a top 234 and a bottom 236. The body 230 includes opposed sides 238 that extend between the top 234 and the bottom 236. The sides 238 terminate at the front 216 and extend rearward from the front 216. Optionally, the sides 238 are perpendicular to the front 216. A shroud 240 extends rearward from the rear 222 of the housing 212 and covers portions of the contact modules 218. The shroud 240 extends from the top 234 in the illustrated embodiment, however the shroud 240 may extend from the bottom 236 and/or the one or more of the sides 238 in addition to, or in the alternative to, extending from the top 234. The shroud 240 may be used to guide and/or hold the contact modules 218. In an alternative embodiment, the body 230 may not include a shroud extending therefrom.

A portion of the body 230 defines a shoulder 242 that extends downward over and faces the mating edge 72 (shown in FIG. 1) of the first circuit board 58. In the illustrated embodiment, the shoulder 242 is provided at the bottom 236 and the rear 222 of the housing 212. The shoulder 242 is rearward facing and extends between the bottom 236 and the contact modules 218. Optionally, the shoulder 242 may be positioned proximate to the mating edge 72 with clearance therebetween. The shoulder 242 extends below the mounting surface 70 (shown in FIG. 1) of the first circuit board 58.

In an exemplary embodiment, multiple contact modules 218 are used. The contact modules 218 may be identical to one another, or alternatively different types of contact modules 218 may be used. For example, in the illustrated embodiment, two different types of contact modules 218 are utilized, namely "A" type contact modules 244 and "B" type contact modules 246. The contact modules 244, 246 are arranged in an alternating sequence with seven "A" type contact modules 244 and seven "B" type modules 246. While fourteen contact modules 218 are illustrated, any number of contact modules 218 may be utilized. Additionally, more than two types of contact modules 218 may be used, and the different types of contact modules 218 may be used in any order depending on the particular application.

The contact module 218 includes a contact module body 270 having opposed sides 272, 274. The contact module body 270 holds the contacts 220. The contacts 220 include mating portions 276 that extend from the contact module body 270 and contact tails 278 that extend from the contact module body 270. Portions of the contacts 220 are encased by the contact module body 270. Optionally, the contact module body 270 may be overmolded over the contacts 220 with the mating portions 276 and the contact tails 278 extending from the contact module body 270. Optionally, the contacts 220 may be formed from a lead frame and the contact module body 270 may be overmolded around the lead frame. Alternatively, individual signal contacts, such as stamped and formed contacts, may be separately positioned within the contact module body 270.

The contact module body 270 includes a forward mating edge 280 and a bottom mounting edge 282 that is perpendicular to the mating edge 280. The contact module body 270 also includes a rear edge 284 opposite the mating edge 280 and a top edge 286 opposite the mounting edge 282.

The contacts 220 generally extend between the mating edge 280 and the mounting edge 282 along a conductor plane.

The mating portions 276 extend from the mating edge 280. The contact tails 278 extend from the mounting edge 282. The contacts 220 may be arranged in pairs with two signal contacts representing a differential pair, and each pair being separated by ground contacts.

The mating portions 276 of the contacts 220 are arranged in a predetermined pattern. Different types of contact modules 244, 246 may have mating portions 276 arranged differently. For example, the "B" type contact modules 246 may have a different arrangement of mating portions 276 than the "A" type contact module 246.

The contact tails 278 may be eye-of-the-needle type contacts that fit into vias in the first circuit board 58 (shown in FIG. 1). Other types of contacts may be used for through hole mounting or surface mounting to the first circuit board 58. Different types of contacts may be used to terminate the contact module 218 to cables rather than to the first circuit board 58, in alternative embodiments.

In the illustrated embodiment, at least some of the contacts 220 represent ground contacts that are part of the lead frame and held within the contact module body 270. The ground contacts may be connected to corresponding ground mating contacts of the mating connectors 64, 66. Alternatively, rather than ground contacts held by the contact module body 270, a separate shield (not shown) may be coupled to the contact module body 270, where the shield has ground contacts extending therefrom that are interspersed in between the signal contacts of the contact module 218. In other alternative embodiments, at least some of the contacts 220 represent power contacts. The signal, ground and/or power contacts may have the same lengths, or alternatively, may have different lengths to define a sequential mating interface.

Figure 3:
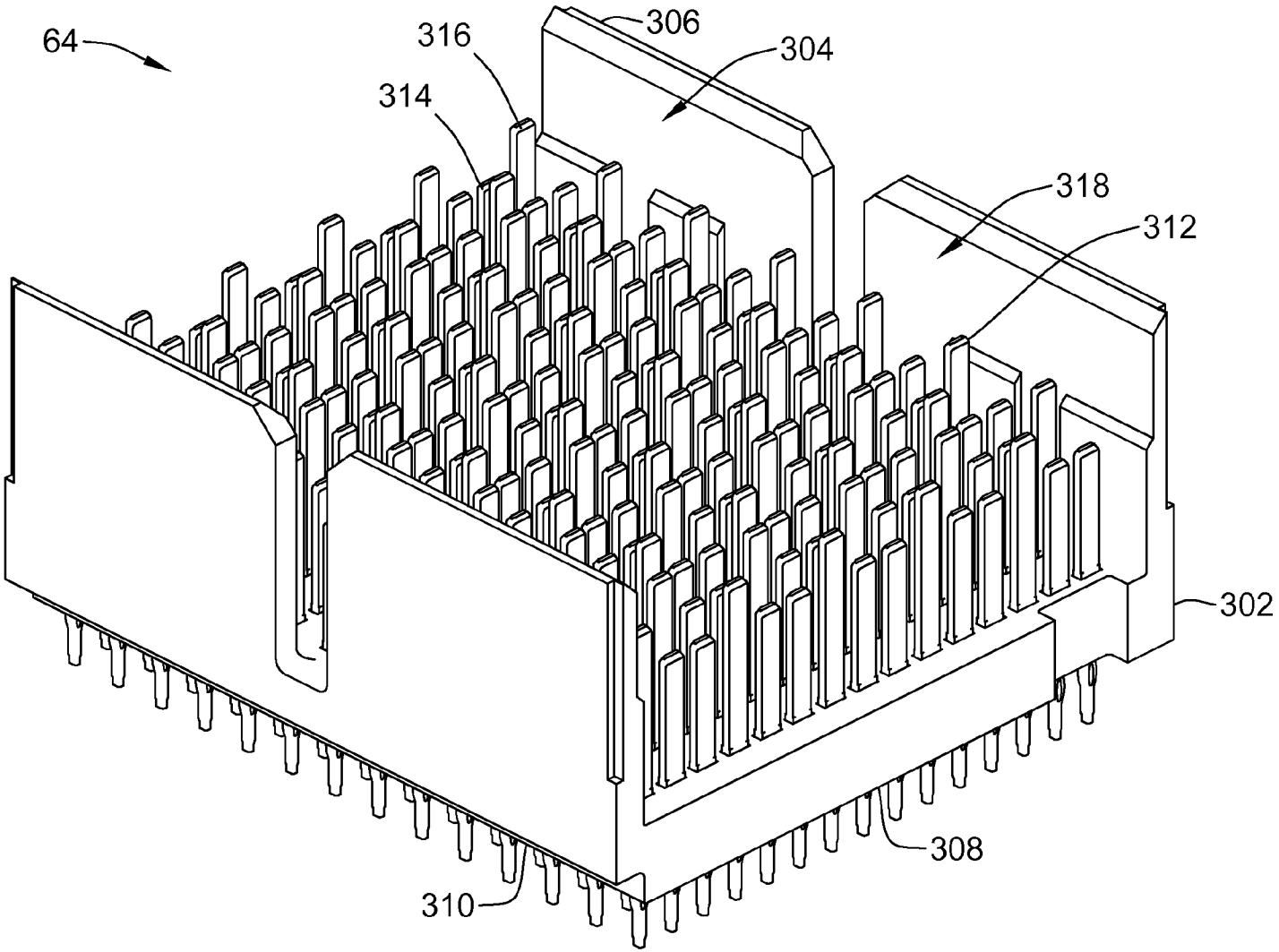
FIG. 3 is a front perspective view of a header connector of the mating connector assembly shown in FIG. 1.

FIG. 3 is a front perspective view of the first mating connector 64 of the mating connector assembly 52 (shown in FIG. 1). The second mating connector 66 (shown in FIG. 1) may be substantially similar to the first mating connector 64. Like components and features of the second mating connector 66 may be identified with similar reference numerals.

The mating connector 64 includes a housing 302 having a mating end 304 at a front 306 of the housing 302 and a mounting end 308 at a rear 310 of the housing 302. A plurality of mating contacts 312 are held by the housing 302 and are arranged for mating with the contacts 220 (shown in FIG. 2). Optionally, the mating contacts 312 may be blade-type contacts having a generally rectangular cross-section, however other contact types are possible in alternative embodiments. The mating contacts 312 are configured to be electrically connected to the second circuit board 68 (shown in FIG. 1). The mating contacts 312 include a subset of signal contacts 314 and a subset of ground contacts 316. In an exemplary embodiment, the ground contacts 316 are longer than the signal contacts 314 such that the ground contacts 316 engage the contacts 220 prior to the signal contacts 314 engaging the contacts 220. As such, the mating connector 64 has a sequential mating interface. Optionally, the mating connector 64 may include other types of mating contacts, such as power contacts (not shown). The power contacts may have a length that is different from the ground contacts 316 and/or the signal contacts 314. Additionally, the mating connector 64 may have signal contacts 314 of different lengths.

The housing 302 includes a chamber 318 that receives at least a portion of the first electrical connector 54 (shown in FIG. 1). The mating contacts 312 are arranged within the chamber 318 in a complementary array for mating with corresponding contacts 220 of the first electrical connector 54.

Returning to FIG. 1, the first mating connector 64 is identical to the second mating connector 66 (shown in FIG. 1). The first and second mating connectors 64, 66 are attached to the second circuit board 68 (shown in FIG. 1) such that the first and second mating connectors 64, 66, and other mating connectors depending on the particular application, and the second circuit board 68 define an assembly 52 that may be handled as a single unit.

The mating connector assembly 52 may be coupled to the electrical connector system 50 as a single unit, or alternatively, the electrical connector system 50 may be coupled to the mating connector assembly 52 as a single unit. As such, the first and second mating connectors 64, 66 are mated to the first and second electrical connectors 54, 56 during the same mating operation. The mating forces needed to mate the mating connectors 64, 66 with the electrical connectors 54, 56 are cumulative. As will be described in further detail below, by offsetting the first and second electrical connectors 54, 56 on the first circuit board 58, the mating forces may be reduced. For example, the first and second electrical connectors 54, 56 may be sequentially mated to shift the timing of mating of the contacts, which may reduce the overall mating forces.

Figure 4:
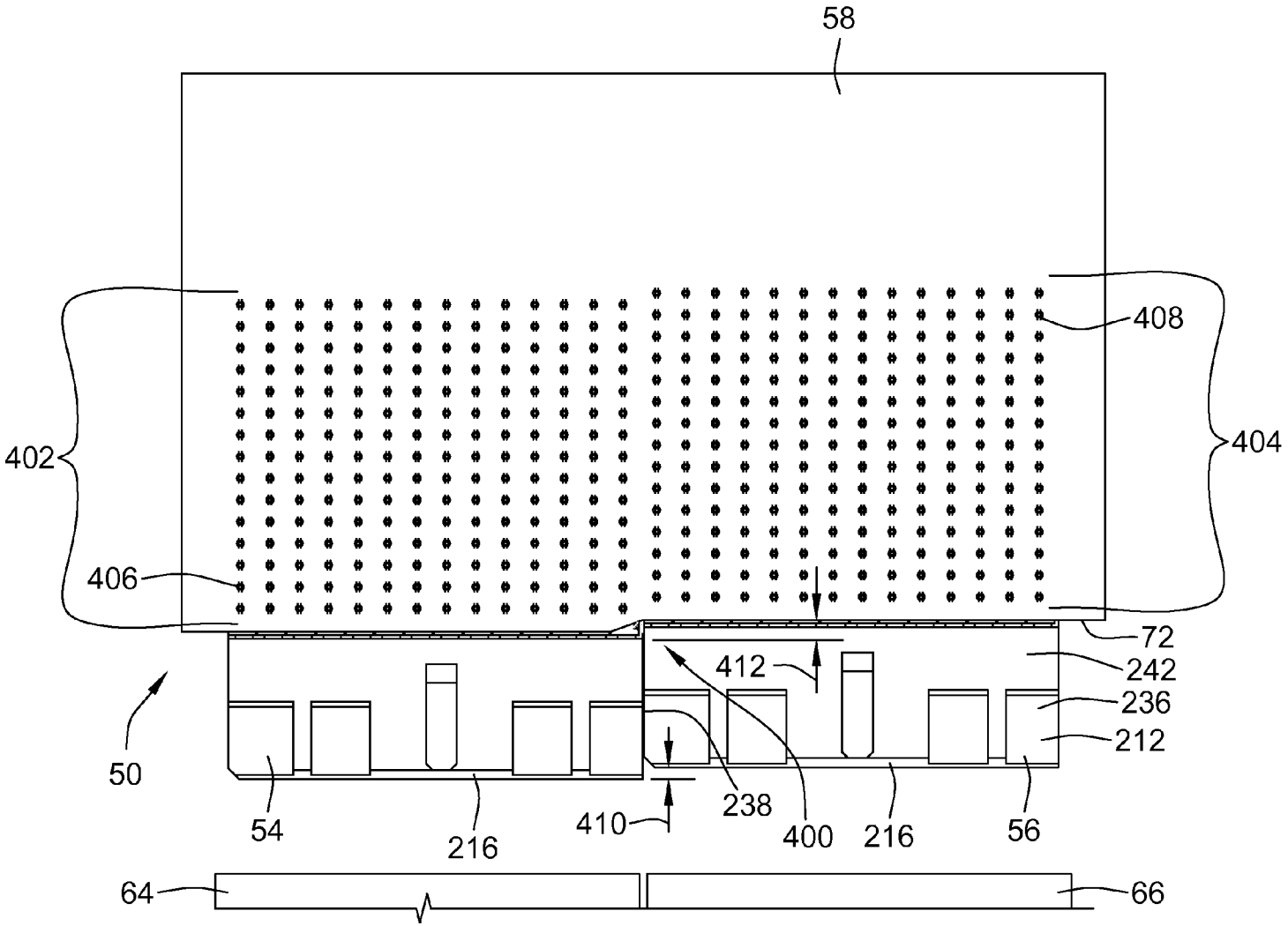
FIG. 4 is a bottom view of the electrical connector system.

FIG. 4 is a bottom view of the electrical connector system 50 illustrating the first and second electrical connectors 54, 56 mounted to the first circuit board 58. The bottom of the first circuit board 58 is illustrated in FIG. 4. Portions of the electrical connectors 54, 56 hang over the mating edge 72 of the circuit board 58. For example, the bottoms 236 of the housings 212 hang over the mating edge 72 such that the shoulders 242 face the mating edge 72.

In an exemplary embodiment, the mating edge 72 of the circuit board 58 is non-planar and includes a jogged section 400 that steps the mating edge 72. The circuit board 58 has a first mounting portion 402 on one side of the jogged section 400 and the circuit board 58 has a second mounting portion 404 on the other side of the jogged section 400. The jogged section 400 changes the position of the mating edge 72 such that the first mounting portion 402 is positioned forward of the second mounting portion 404. The first mounting portion 402 is positioned rearward of the mating edge 72 a similar distance as the second mounting portion 404 is positioned rearward of the mating edge 72. The first electrical connector 54 is mounted to the first mounting portion 402. The second electrical connector 56 is mounted to the second mounting portion 404. Any number of jogged sections 400 may be provided to stagger the positioning of the electrical connectors mounted to the circuit board 58. The jogged sections 400 may be stepped in either the forward direction or the rearward direction. Alternatively, the mating edge 72 may be straight and not include any jogged sections 400.

The first mounting portion 402 includes an array of vias 406 defining a particular pinout pattern that receives the contacts 220 of the first electrical connector 54. The second mounting portion 404 includes an array of vias 408 that receives the contacts 220 of the second electrical connector 56. In an exemplary embodiment, the pinout of the arrays of vias 406, 408 are identical to one another, with the array of vias 406 being offset with respect to the array of vias 408. Optionally, both arrays may be offset from the mating edge 72 by the same amount, such that the arrays on opposite sides of the jogged section 400 are offset by the same amount as the amount of offset of the jogged section 400. The positioning of the vias 406, 408 determine the mounting position of the electrical connectors 54, 56. As such, the amount of offset of the vias 406, 408 determines the amount of offset of the electrical connectors 54, 56. The vias 406, 408 in each array are arranged in rows and columns. Optionally, each row or each column may be offset with respect to an adjacent row or column. Optionally, the array of vias 406, 408 may include more vias than the number of contacts 220. As such, different sized electrical connectors 54, 56 may be connected to the mounting portions 402, 404. For example, the mounting portions 402, 404 may receive electrical connectors having ten contact modules as well as electrical connectors having fourteen contact modules.

In an exemplary embodiment, each array of vias 406, 408 is set back from the mating edge 72 by the same amount. Because the mating edge 72 is stepped, the arrays of vias 406, 408 are also stepped. When the electrical connectors 54, 56 are mounted to the circuit board 58, the electrical connectors 54, 56 are likewise stepped or offset with respect to one another. The electrical connectors 54, 56 have an offset 410 that is equal to an offset 412 of the mating edge 72 on either side of the jogged section 400. In the illustrated embodiment, the offsets 410, 412 are approximately 0.7 mm, however the amount of the offsets 410, 412 may be different in alternative embodiments.

The fronts 216 of the first and second electrical connectors 54, 56 are staggered with respect to one another. The fronts 216 define the initial mating interfaces of the first and second electrical connectors 54, 56 for mating with the first and second mating connectors 64, 66, which are represented schematically in FIG. 4. The mating interfaces of the electrical connectors 54, 56 are both planar and parallel to one another, however, are non-coplanar with respect to one another. Rather, the mating interface of the first electrical connector 54 is positioned forward of the mating interface of the second electrical connector 56. In the illustrated embodiment, the mating interface of the second electrical connector 56 is recessed from the mating interface of the first electrical connector 54. The mating interface of the second electrical connector 56 is set back such that the mating interface is lined up with a portion of the side 238 of the electrical connector 54. The mating interfaces of the mating connectors 64, 66 are generally coplanar with one another. As such, the mating interfaces of the electrical connectors 54, 56 mate with the mating connectors 64, 66 at different times.

Figure 5:
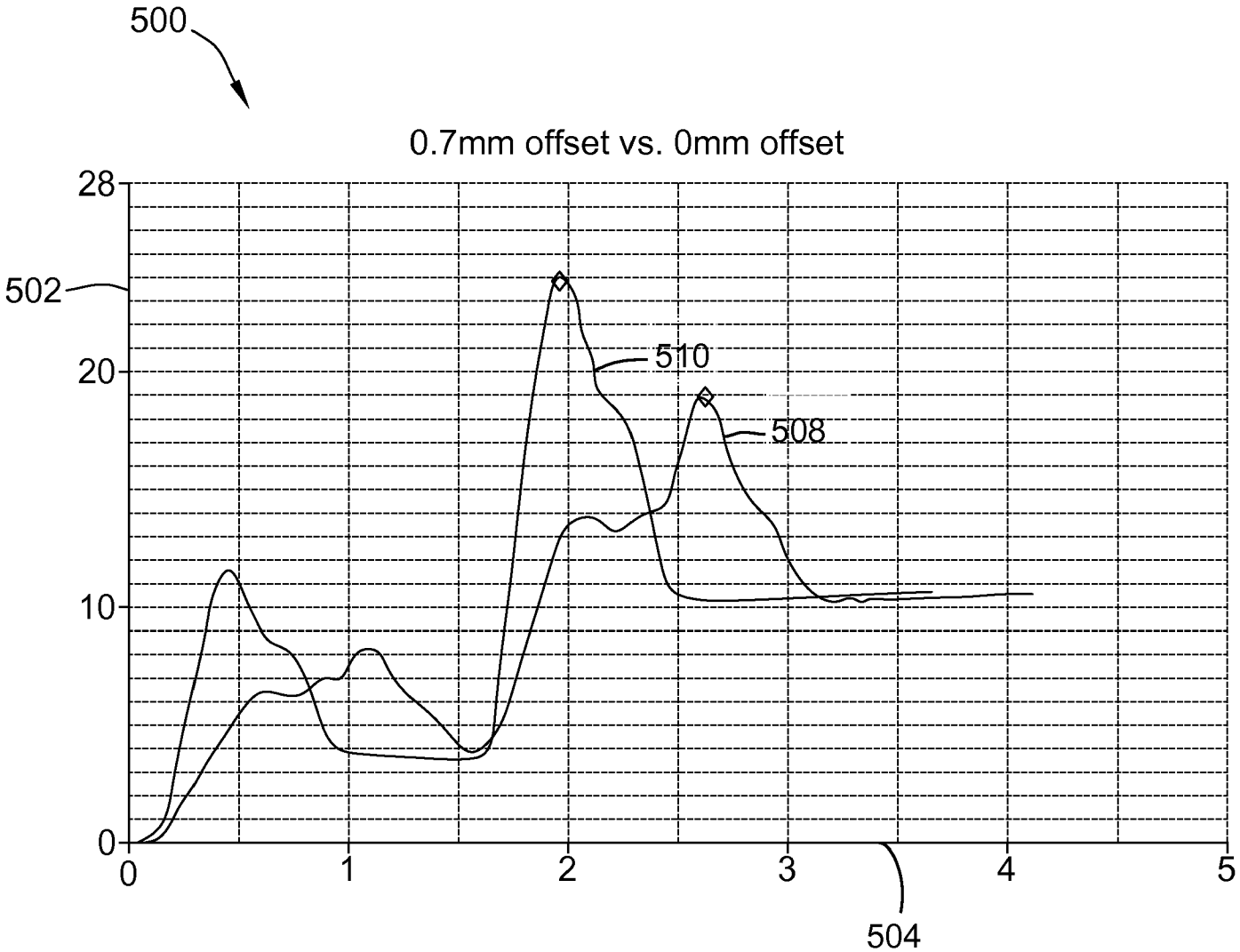
FIG. 5 illustrates a mating force plot.

FIG. 5 illustrates a mating force plot 500 illustrating force 502 (on the vertical axis) versus mating distance 504 (on the horizontal axis), such as in pounds and millimeters, respectively. The mating force plot 500 illustrates an offset mating force 508 exemplary of a situation when mating the electrical connectors 54, 56 (shown in FIG. 1) with the mating connectors 64, 66 and with the offset of the electrical connectors 54, 56. The mating force plot 500 also illustrates a non-offset mating force 510 exemplary of a situation when mating the same electrical connectors 54, 56 with the same mating connectors 64, 66 without the offset of the electrical connectors 54, 56.

When mating with the offset, the contacts 220 of the first electrical connector 54 engage and slide along the mating contacts 312 of the first mating connector 64 prior to the contacts 220 of the second electrical connector 56 engaging and sliding along the mating contacts 312 of the second mating connector 66. When mating with the offset, the mating forces, even though cumulative, do not occur simultaneously, but rather are offset or shifted. As such, the mating forces may be shifted in time and shifted along the mating distance, thus reducing the overall mating force at any given point along the mating operation. When mating without the offset, the mating forces are cumulative and occur simultaneously.

The mating force plot 500 is representative of mating two electrical connectors having both ground contacts and signal contacts, where the ground contacts mate first and the signal contacts mate second in a sequential mating scheme. The offset mating force 508 shows the forces being shifted, which reduces the overall mating force as compared to the non-offset mating force 510. The mating forces 508, 510 generally include an initial spike in mating force during the initial mating of the ground contacts 220, 312, which may be referred to as a lead in mating force. The offset mating force 508 tends to have a double spike configuration for the ground contacts and a double spike configuration for the signal contacts because of the offset in the electrical connectors 54, 56. In contrast, the non-offset mating force 510 tends to have a single spike configuration for the ground contacts and a single spike configuration for the signal contacts because all of the ground contacts mate simultaneously. The mating forces 508, 510 are then reduced as the contacts 220, 312 are further mated, which may be referred to as a sliding mating force. The sliding mating force arises from sliding friction between the contacts 220, 312. The mating forces 508, 510 have a second spike, which represents the initial mating of the signal contacts 220, 312. The offset mating force 508 tends to have a double spike configuration because of the offset in the electrical connectors 54, 56, whereas the non-offset mating force 510 tends to have a single spike configuration because all of the ground contacts mate simultaneously. The mating forces 508, 510 are then reduced as the contacts 220, 312 are further mated, which may be referred to as a sliding mating force.

In the illustrated embodiment, the maximum of the offset mating force 508 is approximately 19 pounds of force whereas the maximum of the non-offset mating force 510 is approximately 24 pounds of force. As such, the offset of the electrical connectors 54, 56 reduces the maximum mating force by approximately 20%. The mating force plot 500 is merely illustrative of a reduction in mating force due to offsetting the electrical connectors 54, 56. Many factors could affect the mating forces of any particular electrical connector system. For example, the number of contacts being mated, the type of contacts being mated, the characteristics of the contacts being mated, the contact wipe length, the amount of sequencing of the contacts being mated, the number of electrical connectors being mated, the number of stages or offsets of electrical connectors being mated, and the like. While a similar result may be achievable by staging the contacts within each of the electrical connectors 54, 56 (e.g. having signal contacts of different length within each contact) as opposed to offsetting the electrical connectors 54, 56 themselves, such a solution is more costly and complex. For example, stamping and forming the leadframes that make the contact modules would be more difficult, having different tooling and dies to make the leadframes and contact modules would be more costly, and the like.

Alternative electrical connector systems are possible for offsetting the mating interfaces of adjacent electrical connectors, to reduce the overall mating forces when mating the electrical connectors to corresponding mating connectors. For example, rather than jogging the mating edge 72 of the circuit board 58, the mating faces 214 of the electrical connectors 54, 56 may be offset in other ways. For example, the first electrical connector 54 may be held off and away from the mating edge 72 of the circuit board 58 such that a gap exists between the housing 212 of the first electrical connector 54 and the mating edge 72. Alternatively, the housing 212 of the first electrical connector 54 may be designed differently than the housing of the second electrical connector 56. For example, the housing 212 of the first electrical connector 54 may be thicker than the housing of the second electrical connector 56 such that the mating face 214 of the first electrical connector 54 is held further forward of the mating edge 72 than the mating face of the second electrical connector 56.

In another alternative embodiment, the mating connectors 64, 66 are offset from the second circuit board 68 to provide the sequenced mating as opposed to the electrical connectors 54, 56 being offset. For example, the first mating connector 64 may be arranged such that the mating face thereof is held off the second circuit board by a different amount than the second mating connector 66 such that the mating end 304 and the mating contacts 312 are further outward from the second circuit board 68 than the mating end 304 and the mating contacts 312 of the second mating connector 66.

In other alternative embodiments, the mating connectors 64, 66 may be right angle connectors having a plurality of contact modules, similar to the electrical connectors 54, 56. The mating connectors 64, 66 and/or the electrical connectors 54, 56 may be cable mounted as opposed to board mounted. Even when cable mounted, the connectors may be fixed on a frame, chassis or substrate in position with respect to other connectors. As such, multiple connectors may be mated together as a unit, with mating interfaces of the connectors being offset for staged mating.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector system comprising:

a circuit board having a mounting side and a mating edge; and first and second electrical connectors separately mounted to the mounting side of the circuit board proximate to the mating edge, the first and second electrical connectors each having a housing having a front surface defining a mating interface, the first and second electrical connectors being mounted to the circuit board in an offset configuration with respect to the mating edge such that the front surfaces and the mating interfaces of the first and second electrical connectors are parallel to one another and non-coplanar with respect to one another.

2. The system of claim 1, wherein the mating interfaces are staggered with the mating interface of the second electrical connector being recessed with respect to the mating interface of the first electrical connector.

3. The system of claim 1, wherein the the front surfaces are planar, the planar front surfaces being parallel to one another with the front surface of the second electrical connector positioned rearward of the front surface of the first electrical connector.

4. The system of claim 1, wherein the mating edge is non-planar and includes a jogged section, the circuit board having a first mounting portion on one side of the jogged section, the circuit board having a second mating portion on the other side of the jogged section, the first electrical connector mounted to the first mating portion, the second electrical connector mounted to the second mating portion.

5. The system of claim 1, wherein the first and second electrical connectors are configured to be mated with a mating connector assembly having first and second mating connectors, the first and second mating connectors being arranged in a non-offset configuration, the first electrical connector being configured to mate with the first mating connector prior to the second electrical connector mating with the second mating connector.

6. The system of claim 1, wherein each housing of the first and second electrical connectors has a cavity configured to receive an associated mating connector therein, the mating connectors being loaded into the corresponding cavities as a unit, the first and second mating connectors include contacts therein for mating with mating contacts of the corresponding mating connectors, the contacts of the first electrical connector being configured to be engaged by mating contacts prior to the contacts of the second electrical connector to define a sequential mating interface.

7. The system of claim 1, wherein each housing of the first and second electrical connectors has a mounting surface perpendicular to the front surface, the mounting surface being mounted to the mounting side of the circuit board.

8. The system of claim 1, wherein the circuit board includes a first mounting portion and a second mounting portion, the first electrical connector being mounted to the first mounting portion, the second electrical connector being mounted to the second mounting portion, the first and second mounting portions having pinout patterns of vias, the pinout pattern of the first mounting portion being staggered with respect to the pinout pattern of the second mounting portion such that the vias are not aligned with one another.

9. The system of claim 1, wherein each housing of the first and second electrical connectors has a shoulder at a bottom of the housing, the housing being mounted to the circuit board such that the bottom engages the mounting side and the shoulder faces the mating edge.

10. The system of claim 1, wherein the first and second electrical connectors each have a plurality of contacts, each contact having a length, the lengths being longer than the amount of offset between the first and second electrical connectors such that the contacts of the first electrical connector are configured to mate with mating contacts of a first mating connector and the contacts of the second electrical connector are configured to mate with mating contacts of a second mating connector, the ends of the mating contacts of the first and second mating contacts being coplanar with one another.

11. The system of claim 1, wherein each housing of the first and second electrical connectors has a plurality of contact channels, each housing holding a plurality of contact modules, the contact modules having contact module bodies holding a plurality of contacts with mating portions of the contacts extending forward from an edge of the contact module body, the contact modules being coupled to the housing such that the mating portions extend into corresponding contact channels.

12. The system of claim 1, wherein each housing of the first and second electrical connectors holds a plurality of contact modules, each contact module having a leadframe and an overmold body overmolded over the leadframe.

13. An electrical connector system comprising:

a circuit board having a mounting side extending in a rearward direction from a mating edge;

a first electrical connector mounted to the mounting side of the circuit board proximate to the mating edge, the first electrical connector comprising a housing having a mating end and a mounting end perpendicular to the mating end, the mounting end being mounted to the mounting side of the circuit board, the first electrical connector comprising a plurality of contact modules loaded into the housing, the contact modules of the first electrical connector including contacts positioned proximate to the mating end of the housing; and a second electrical connector mounted to the mounting side of the circuit board proximate to the mating edge, the second electrical connector comprising a housing having a mating end and a mounting end perpendicular to the mating end, the mounting end being mounted to the mounting side of the circuit board, the second electrical connector comprising a plurality of contact modules loaded into the housing, the contact modules of the second electrical connector including contacts positioned proximate to the mating end of the housing;

wherein the first and second electrical connectors are separately mounted to the circuit board in an offset configuration such that the mating end of the second electrical connector is offset in the rearward direction with respect to the first electrical connector, the contacts of the first electrical connector are configured for mating engagement prior to the contacts of the second electrical connector.

14. The system of claim 13, wherein the contacts define mating interfaces staggered with respect to one another with the mating interface of the second electrical connector being recessed with respect to the mating interface of the first electrical connector.

15. The system of claim 13, wherein the housings of the first and second electrical connectors include planar fronts defining mating interfaces, the planar fronts being parallel to one another and being non-coplanar with one another with the front of the second electrical connector positioned rearward of the front of the first electrical connector.

16. The system of claim 13, wherein the contacts of the first electrical connector are arranged in at least a first subset and a second subset defined as having different lengths than the contacts of the first subset, and wherein the contacts of the second electrical connector are arranged in at least a first subset and a second subset defined as having different lengths than the contacts of the first subset, the first subset of contacts of the first electrical connector are configured to be mated prior to the first subset of contacts of the second electrical connector, the second subset of contacts of the first electrical connector are configured to be mated prior to the second subset of contacts of the second electrical connector.

17. The system of claim 16, wherein the first subset of contacts of the second electrical connector are configured to be mated prior to the second subset of contacts of the first electrical connector.

18. The system of claim 16, wherein the first subsets of contacts of the first and second electrical connectors represent at least one of power contacts and ground contacts, and wherein the second subset of contacts of the first and second electrical connectors represent signal contacts.

19. The system of claim 13, wherein the mating edge is non-planar and includes a jogged section, the circuit board having a first mounting portion on one side of the jogged section, the circuit board having a second mating portion on the other side of the jogged section, the first electrical connector mounted to the first mating portion, the second electrical connector mounted to the second mating portion.

20. The system of claim 13, wherein the first and second electrical connectors are configured to be mated with a mating connector assembly having first and second mating connectors, the first and second mating connectors being arranged in a non-offset configuration, the first electrical connector being configured to mate with the first mating connector prior to the second electrical connector mating with the second mating connector.

* * * * *